US011498234B2

(12) United States Patent
Monk et al.

(10) Patent No.: US 11,498,234 B2
(45) Date of Patent: Nov. 15, 2022

(54) TENSION KNIFE FOR CUTTING FOOD PRODUCTS

(71) Applicant: LAMB WESTON, INC., Eagle, ID (US)

(72) Inventors: Samuel Monk, Richland, WA (US); Danelle Roan, Kennewick, WA (US); Mark Alan Fow, Kennewick, WA (US); Grayden Howard, Richland, WA (US); Daniel L. Banowetz, Chesterton, IN (US); Michael S. Jacko, Valparaiso, IN (US)

(73) Assignee: Lamb Weston, Inc., Eagle, ID (US)

( * ) Notice: Subject to any disclaimer, the term of this patent is extended or adjusted under 35 U.S.C. 154(b) by 0 days.

(21) Appl. No.: 17/314,212

(22) Filed: May 7, 2021

(65) Prior Publication Data

US 2021/0347077 A1 Nov. 11, 2021

Related U.S. Application Data

(60) Provisional application No. 63/021,715, filed on May 8, 2020.

(51) Int. Cl.
*B26D 1/03* (2006.01)
*B26D 1/00* (2006.01)

(52) U.S. Cl.
CPC ..... *B26D 1/03* (2013.01); *B26D 1/0006* (2013.01); *B26D 2001/0033* (2013.01)

(58) Field of Classification Search
CPC ..... B26D 1/03; B26D 1/0006; B26D 1/553; B26D 3/18; B26D 3/185; B26D 3/26;
(Continued)

(56) References Cited

U.S. PATENT DOCUMENTS 5,343,623 A 9/1994 Cole et al.
2001/0035082 A1* 11/2001 Cole ..... B26D 1/0006 83/932

(Continued)

FOREIGN PATENT DOCUMENTS

JP H11104993 A 4/1999
JP 2013252604 A 12/2013
KR 20140063676 A 5/2014

OTHER PUBLICATIONS

Notification of Transmittal of the Internationalsearch Report and the Written Opinion of the International Searching Authority,or the Declaration dated Aug. 27, 2021 for App. No. PCT/US21/31236.

*Primary Examiner* — Jennifer S Matthews
(74) *Attorney, Agent, or Firm* — Ryan T. Grace; Advent, LLP

(57) ABSTRACT

A tension knife includes an elongate knife body with a thin, flat profile. The tension knife defines first and second mounting points at opposing ends of the knife body. The knife body has a characteristic width across a length of the knife body between the first and second mounting points. The characteristic width of the knife body defines a centerline between a leading edge of the knife body and a trailing edge of the knife body. One or more of the first and second mounting points has a focus between the centerline of the knife body and the leading edge. A frame can be configured to support and tension the tension knife to form a tension knife assembly. Clamp blocks can be used to mount the tension knife to the frame at the first and second mounting points, where one or more of the clamp blocks is configured to rotate with respect to the frame to tension the leading edge of the tension knife.

18 Claims, 20 Drawing Sheets

(58) Field of Classification Search
CPC .... B26D 2001/0053; B26D 2001/0033; B26D 2210/02; Y10S 83/932
See application file for complete search history.

(56) References Cited

U.S. PATENT DOCUMENTS

| | | | | |
|---|---|---|---|---|
| 2006/0185488 | A1 | 8/2006 | Short et al. | |
| 2014/0208917 | A1* | 7/2014 | Whitney | B26D 5/16 83/858 |

* cited by examiner

TENSION KNIFE FOR CUTTING FOOD PRODUCTS

CROSS-REFERENCE TO RELATED APPLICATIONS

The present application claims the benefit under 35 U.S.C. § 119(e) of U.S. Provisional Application Ser. No. 63/021,715, filed May 8, 2020, and titled "TENSION KNIFE FOR CUTTING FOOD PRODUCTS," which is herein incorporated by reference in its entirety.

BACKGROUND

An increasing number of food products are processed before arriving on a consumer's plate. A variety of fruits and vegetables, for example, are cut or shaped and then frozen or otherwise preserved for later use. In order to meet the demand for processed food products and efficiently produce large quantities of such products, the food industry utilizes various equipment for rapidly processing large amounts of foodstuff.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a tension knife that includes an elongate knife body having a thin, flat profile that defines a first mounting point at a first end of the elongate knife body and a second mounting point at a second end of the elongate knife body opposite the first end. The elongate knife body can have a characteristic width across a length of the elongate knife body between the first mounting point and the second mounting point. The characteristic width of the elongate knife body can define a centerline between a leading edge of the elongate knife body and a trailing edge of the elongate knife body opposite the leading edge. At least one of the first mounting point or the second mounting point can have a focus between the centerline of the elongate knife body and the leading edge.

Other aspects of the disclosure relate to a tension knife assembly that includes a tension knife that has an elongate knife body with a thin, flat profile that defines a first mounting point at a first end of the elongate knife body and a second mounting point at a second end of the elongate knife body opposite the first end. The elongate knife body can have a characteristic width across a length of the elongate knife body between the first mounting point and the second mounting point. The characteristic width of the elongate knife body can define a centerline between a leading edge of the elongate knife body and a trailing edge of the elongate knife body opposite the leading edge. At least one of the first mounting point or the second mounting point can have a focus between the centerline of the elongate knife body and the leading edge. The tension knife assembly can also include a frame for supporting and tensioning the tension knife, and a plurality of clamp blocks for mounting the tension knife to the frame at the first mounting point and the second mounting point. At least one of the clamp blocks can be configured to rotate with respect to the frame to tension the leading edge of the tension knife.

Further aspects of the disclosure relate to a tension knife that includes an elongate knife body having a thin, flat profile that defines a first mounting point at a first end of the elongate knife body and a second mounting point at a second end of the elongate knife body opposite the first end. The elongate knife body can have a characteristic width across a length of the elongate knife body between the first mounting point and the second mounting point. The characteristic width of the elongate knife body can define a centerline between a recessed leading edge of the elongate knife body and a trailing edge of the elongate knife body opposite the leading edge. At least one of the first mounting point or the second mounting point can have a focus between the centerline of the elongate knife body and the leading edge.

DRAWINGS

The Detailed Description is described with reference to the accompanying figures. The use of the same reference numbers in different instances in the description and the figures may indicate similar or identical items.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete and will fully convey the scope. Among other things, the features of the disclosure can be embodied as formulations, food products, processes, processes for making food products, and processes for making formulations. The following detailed description is, therefore, not to be taken in a limiting sense.

Referring generally to FIGS. 1 through 21, tension knives 100 and tension knife assemblies 200 are described. A tension knife assembly 200 can be used for cutting food product, such as potatoes or other vegetables. For example, potatoes are carried to a tension knife assembly 200 in a product flow along a food processing path and carried by water through the tension knife assembly 200 where the food products are cut by one or more tension knives 100. It should be noted that although potato food products are described herein, these food products are provided by way of example and are not meant to limit the present disclosure. In embodiments, other various food products can be cut with the tension knives 100 and tension knife assemblies 200, including, but not necessarily limited to: various types of potatoes, sweet potatoes, yams, apples, pears, carrots, and other types of fruits and vegetables with similar flesh density. In some embodiments, food products can be a frozen and/or chilled to provide an appropriate hardness for cutting.

Figure 1:
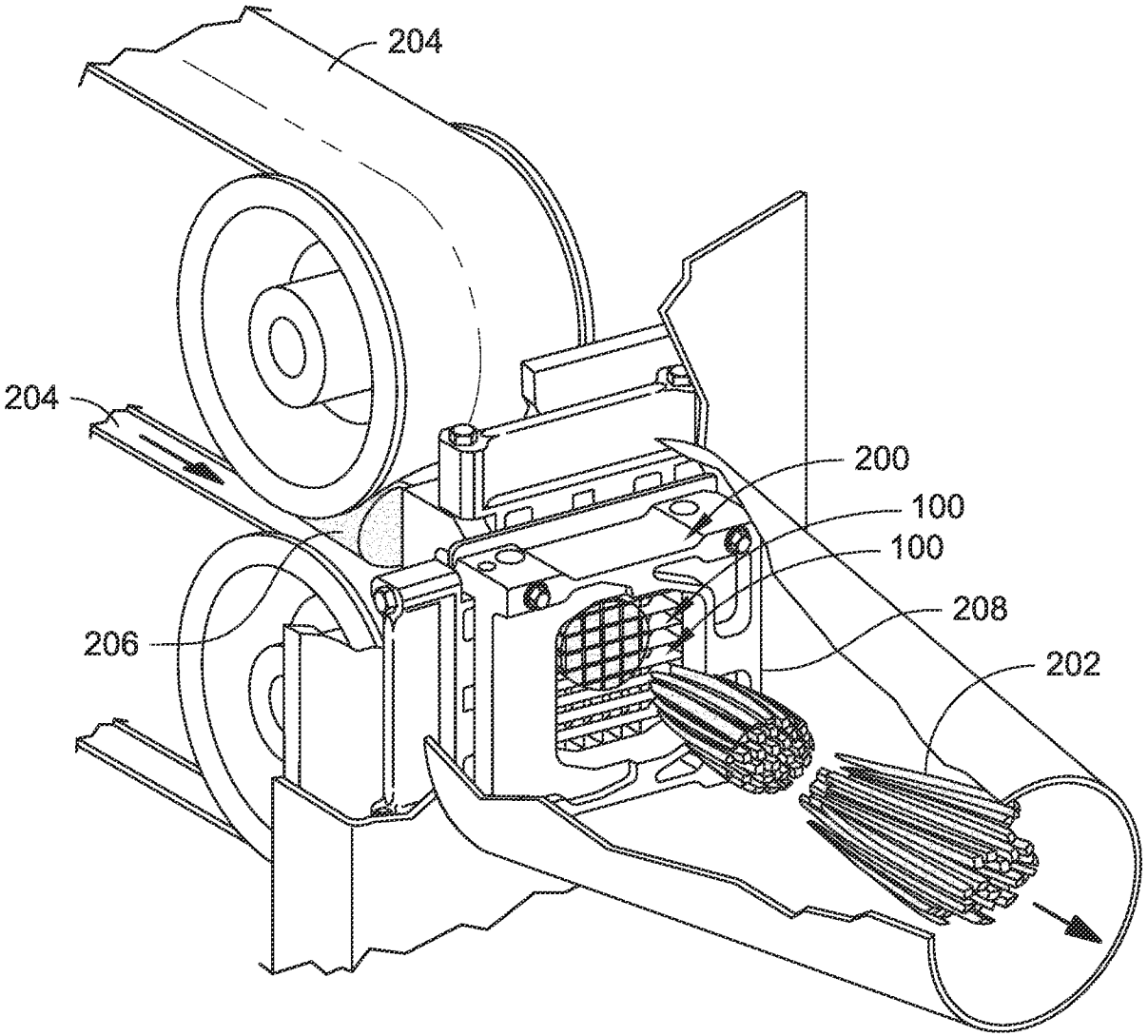
FIG. 1 is an isometric view illustrating a cutting unit for cutting potatoes or other vegetable or fruit products using a grid of knives.

Referring to FIG. 1, cut potato products, such as French fries 202, can be produced using a propulsion device, such as a water gun or feed belts 204, to propel a potato 206 or another vegetable or fruit product at a grid of knives. For example, blades (e.g., tension knives 100) are mounted in a cutting head 208 of a cutting unit, which is positioned at the outlet of adjacent feed belts 204. The momentum of the potato in the product flow from the water gun or feed belts 204 causes the potato to travel through the grid of knives, creating force between the blades or tension knives 100 and the potato. In this manner, a potato can be formed into strips or French fries 202.

Figure 2:
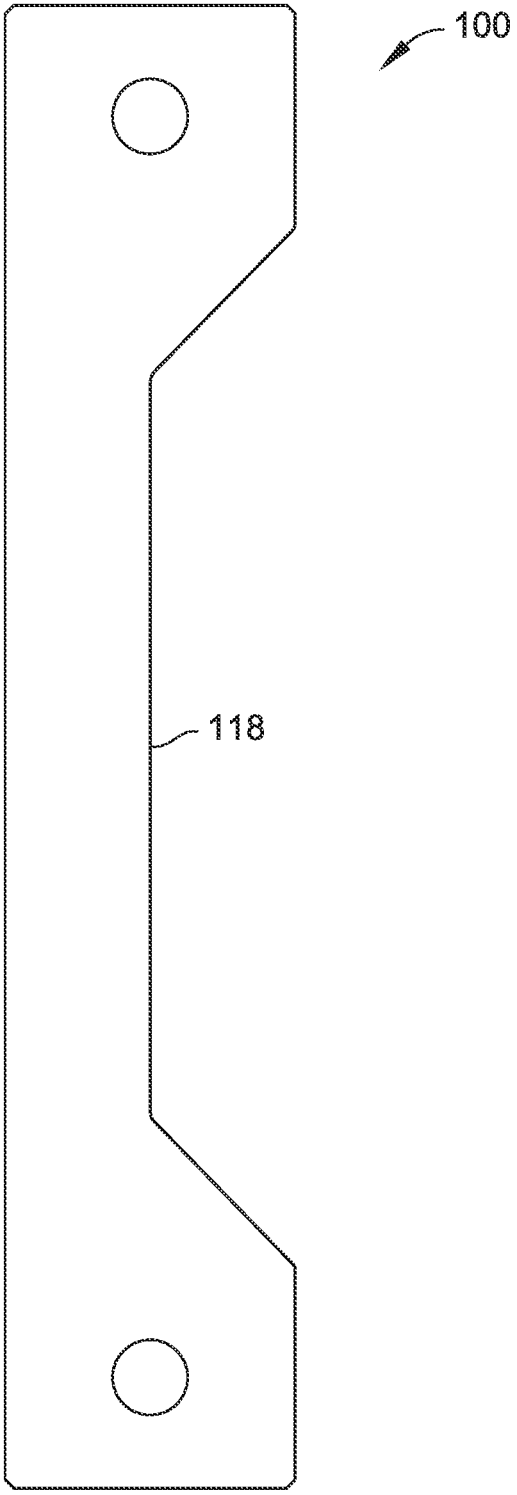
FIG. 2 is a top plan view illustrating a tension knife for a cutting unit, such as the cutting unit illustrated in FIG. 1.
Figure 3:
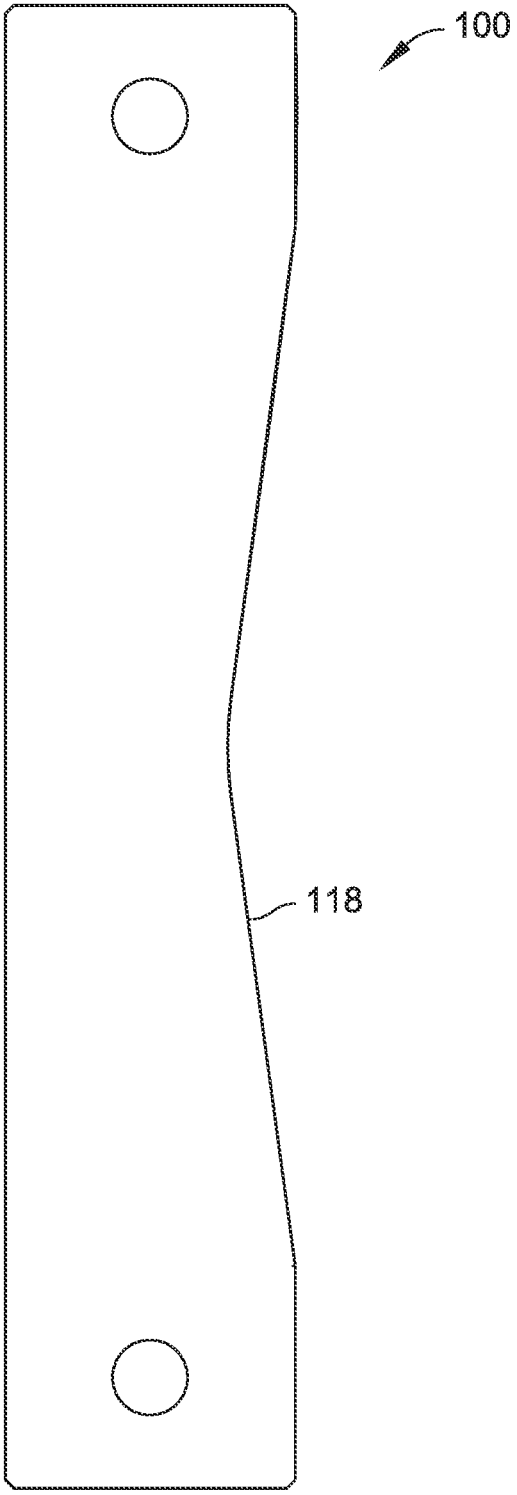
FIG. 3 is a top plan view illustrating another tension knife.
Figure 4:
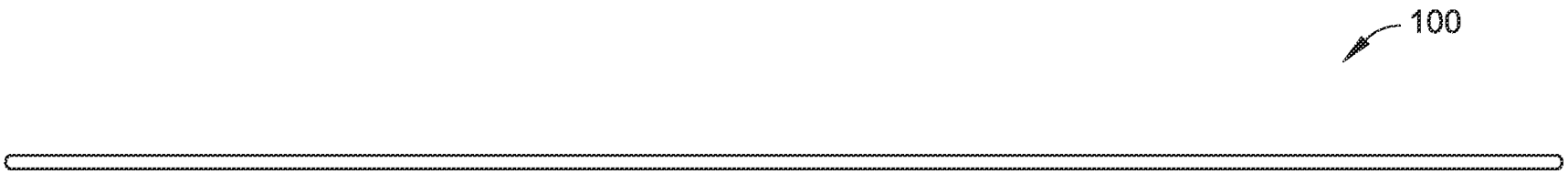
FIG. 4 is a cross-sectional side elevation view illustrating a tension knife, such as the tension knives shown in FIGS. 2 and 3.

With reference to FIGS. 2 through 4, typical tension knives 100 for a cutting unit or tension knife assembly 200, such as the cutting unit of FIG. 1, include recessed leading edges 118, located some distance behind a front edge of the tension knife 100 (with respect to the orientation of the product flow). As shown in FIG. 2, the leading edge 118 of a tension knife 100 may be generally perpendicular with respect to the product flow direction. With reference to FIG. 3, the leading edge 118 of a heavy-duty tension knife 100 may be angled with respect to the product flow direction. As shown in FIG. 4, these knives and their leading edges 118 are not necessarily sharpened (e.g., having a rectangular profile). Rather, in some embodiments the thin material of the tension knives 100 alone may be used to produce large stresses that cut the product.

Figure 5:
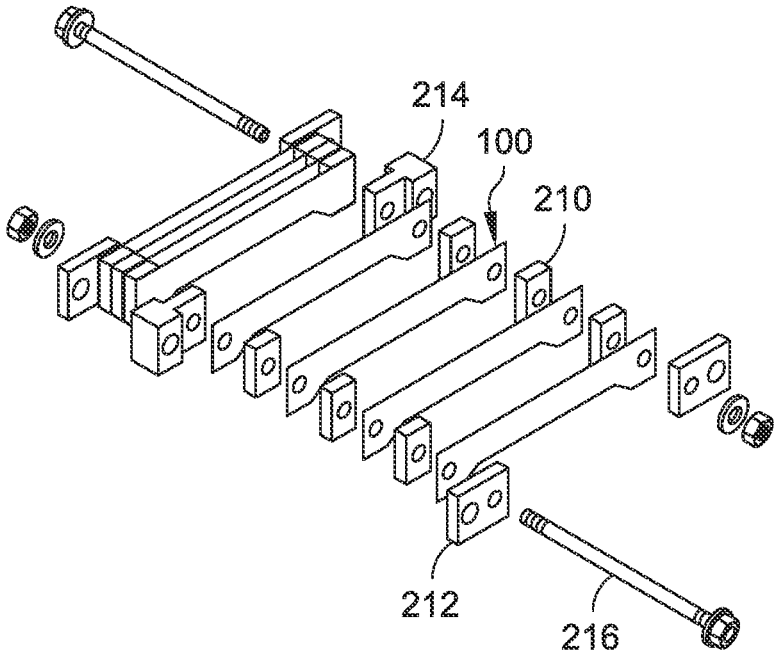
FIG. 5 is an isometric view illustrating a blade assembly for a tension knife assembly of a cutting unit, such as the cutting unit illustrated in FIG. 1.
Figure 6:
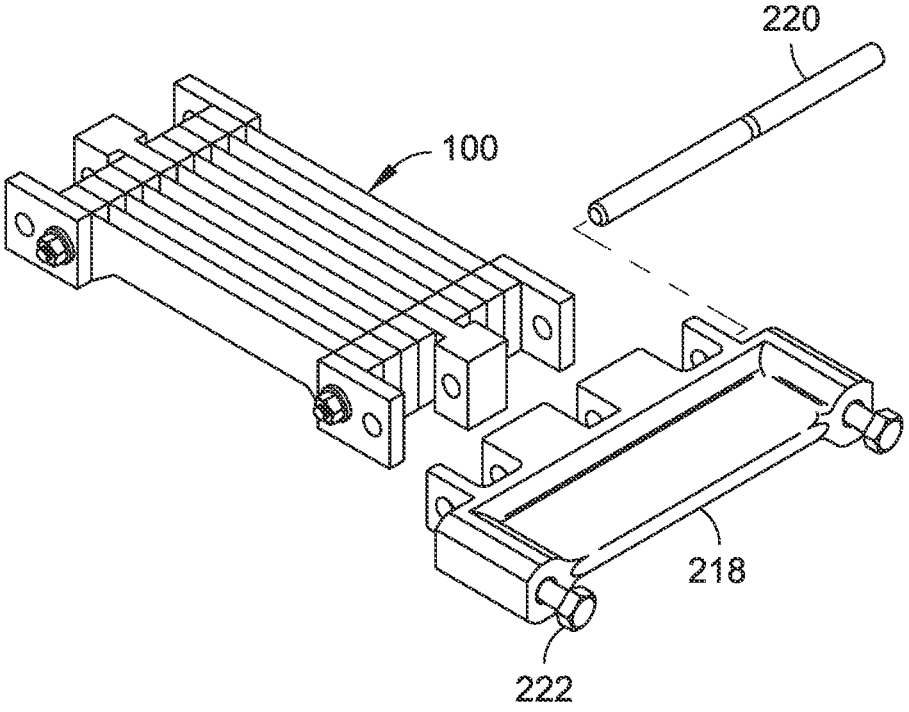
FIG. 6 is an isometric view of the blade assembly illustrating in FIG. 5, further illustrating a tension bar.
Figure 7:
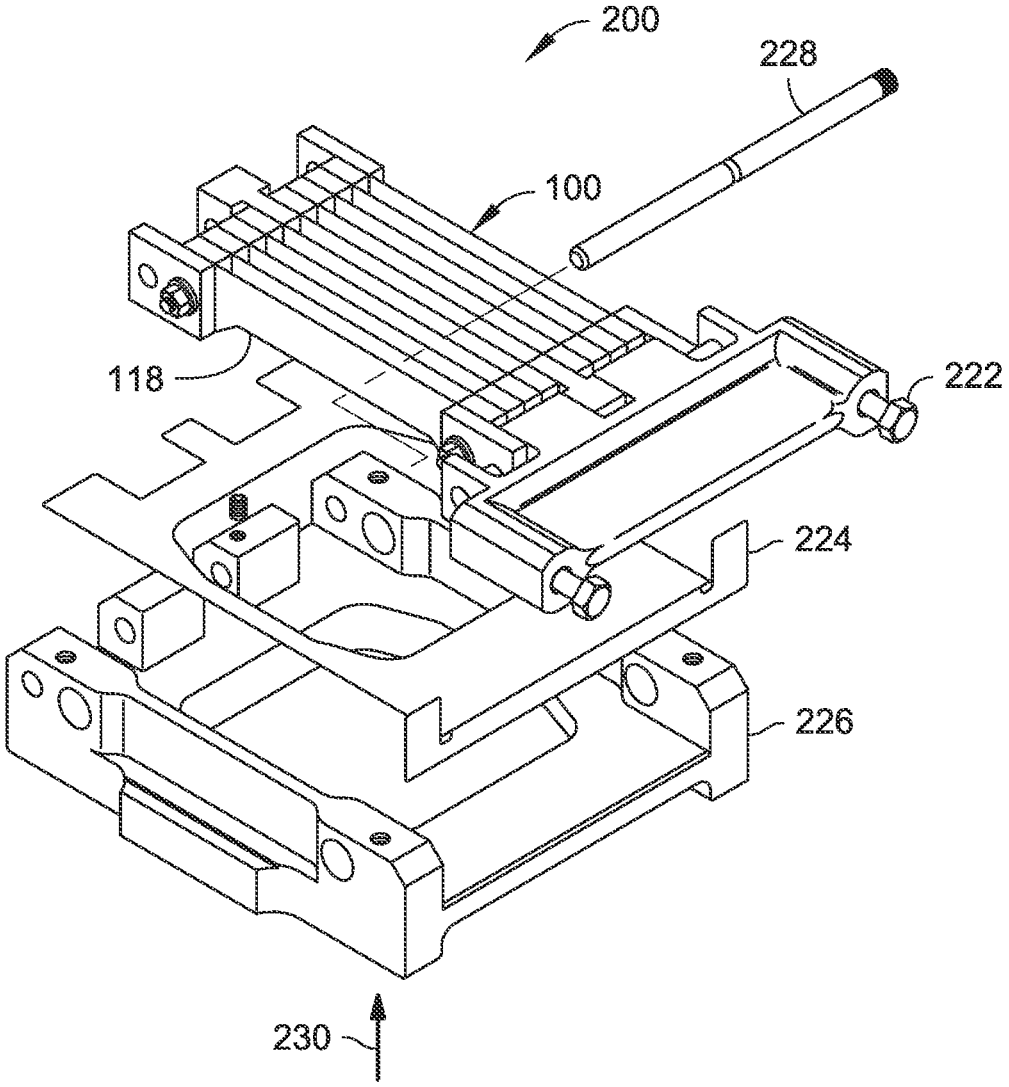
FIG. 7 is an isometric view illustrating a blade assembly and a tension bar, such as the blade assembly and the tension bar illustrated in FIG. 6, and further illustrating a lower base.
Figure 8:
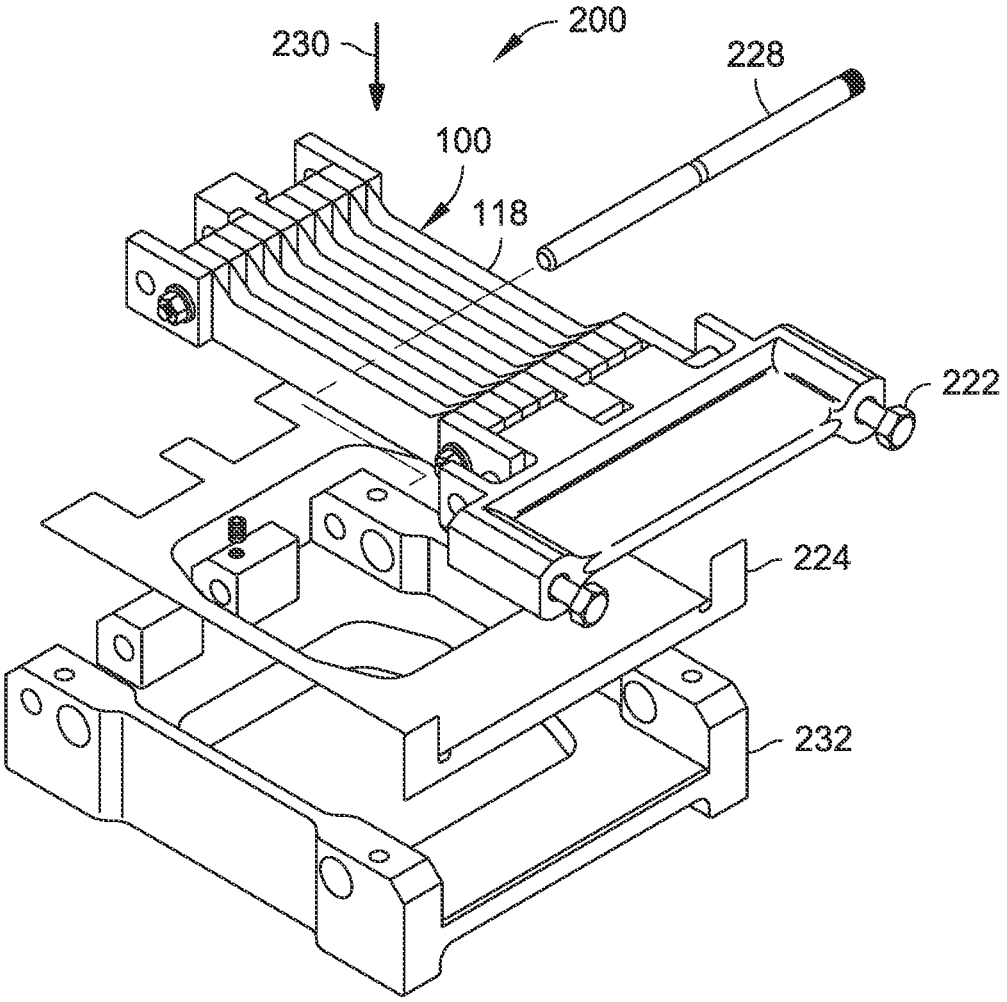
FIG. 8 is an isometric view illustrating a blade assembly and a tension bar, such as the blade assembly and the tension bar illustrated in FIG. 6, and further illustrating an upper base.
Figure 9:
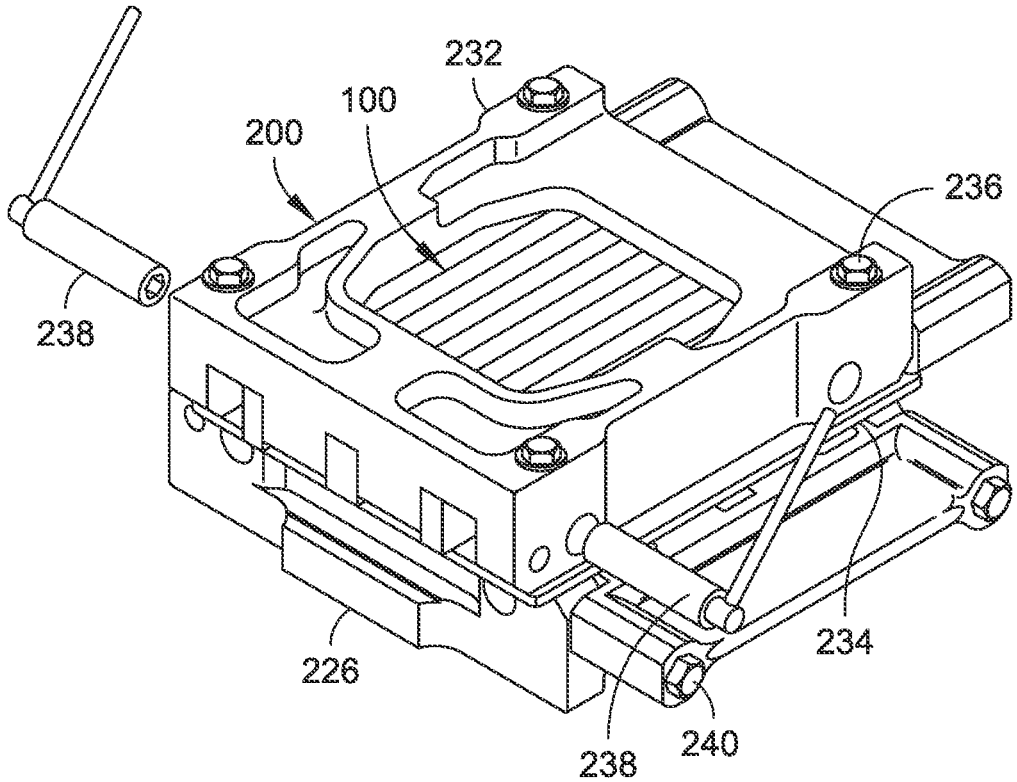
FIG. 9 is an isometric view illustrating two sets of blade assemblies, tension bars, and bases, such as the blade assemblies, tension bars, and bases illustrated in FIGS. 7 and 8, assembled to form a cutting head for a cutting unit, such as the cutting unit illustrated in FIG. 1.
Figure 10:
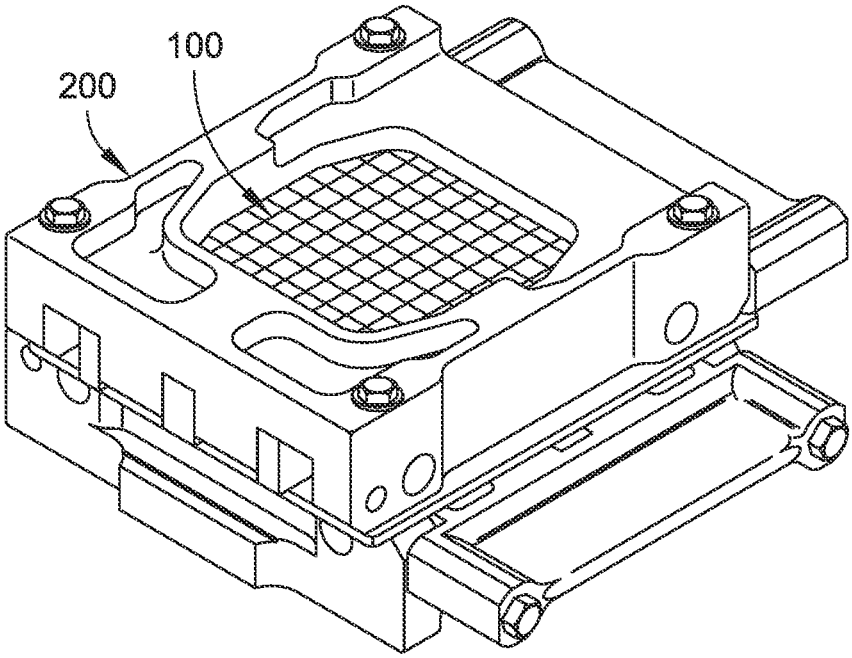
FIG. 10 is an isometric view illustrating a cutting head for a cutting unit, such as the cutting unit illustrated in FIG. 1.

With reference to FIGS. 5 through 10, the assembly of tension knives 100 into a grid is described. For example, blades or knives are clamped together with spacers and bolts, then assembled into a frame. As shown in FIG. 5, a blade assembly can include a spacer 210, an end pull block 212, a center pull block 214, a blade or tension knife 100, and a clamp rod 216. With reference to FIG. 6, a blade and tension bar assembly can include the blade assembly, a tension bar 218, a short tension pin 220, and a tension bolt 222. As shown in FIG. 7, a blade and tension bar assembly (e.g., as described with reference to FIGS. 5 and 6) can be mounted to a lower base. The assembly can include a base insert 224, the blade and tension bar assembly, a lower base 226, a blade edge 118, a long tension pin 228, and a tension bolt 222. A product flow direction 230 is also shown. As shown in FIG. 8, a blade and tension bar assembly (e.g., as described with reference to FIGS. 5 and 6) can also be mounted to an upper base. This assembly can include a base insert 224, the blade and tension bar assembly, an upper base 232, a blade edge 118, a long tension pin 228, and a tension bolt 222. Again, a product flow direction 230 is shown. Referring now to FIGS. 9 and 10, two grid assemblies (e.g., as described with reference to FIGS. 7 and 8) can be placed into a frame at right angles to one another, allowing the knife grids to be tensioned by tightening fasteners, such as tension bolts. For example, an assembled grid can include an upper base 232, a lower base 226, a bearing plate 234, fasteners 236, a hex socket wrench 238, and tension bolts 240.

Figure 11:
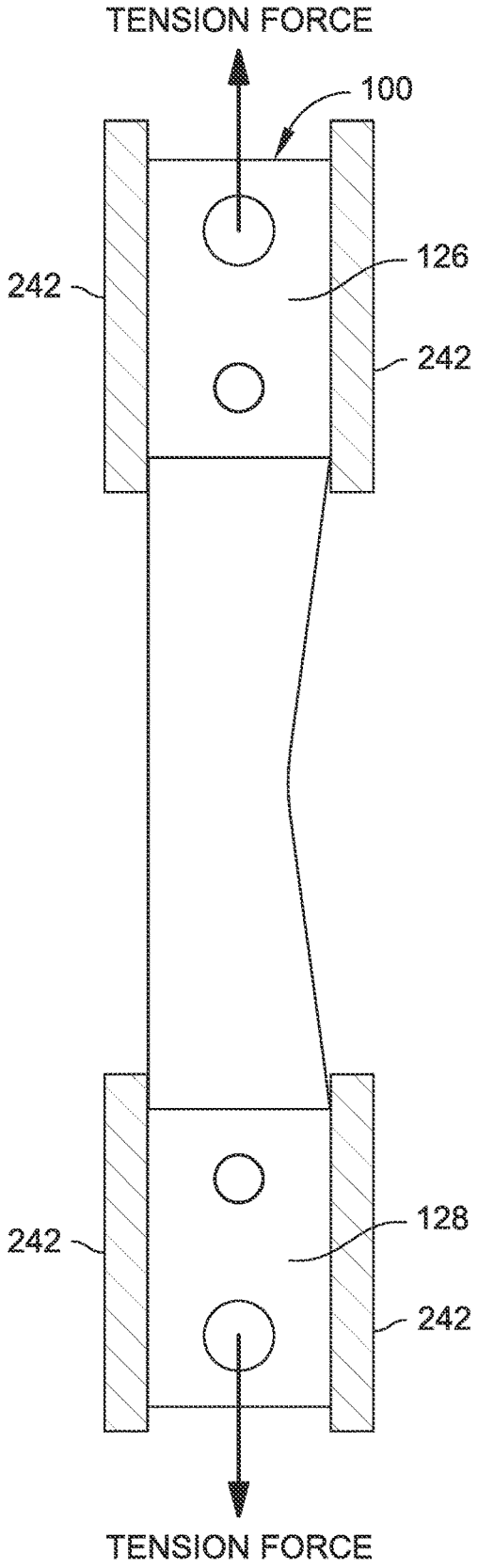
FIG. 11 is a cross-sectional top plan view illustrating a tension knife and spacer blocks for a cutting unit, such as the cutting unit illustrated in FIG. 1.
Figure 12:
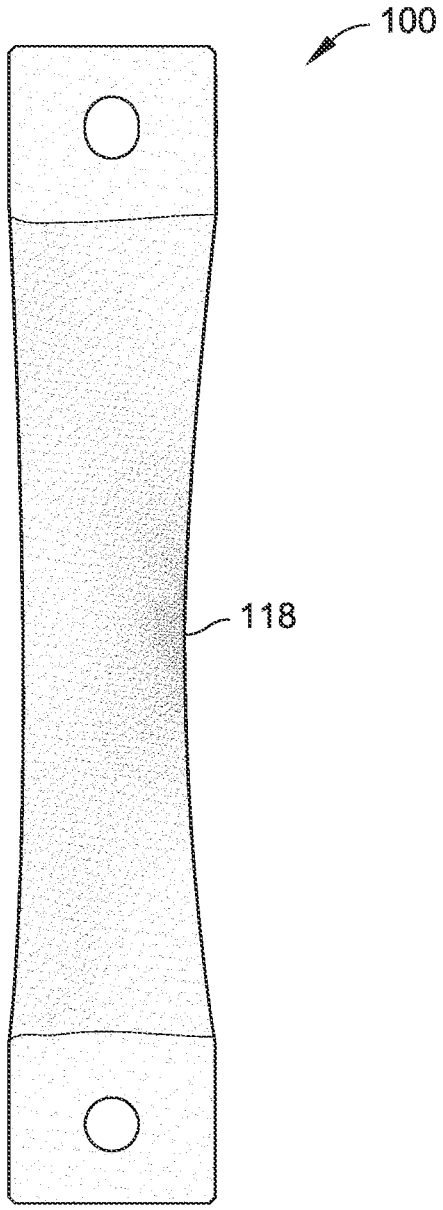
FIG. 12 is a top plan view illustrating a finite element analysis (FEA) structural model of a tension knife, where the tension knife is loaded in tension, and where deflection is exaggerated by twenty-five (25) times.

Referring to FIG. 11, a tension knife 100 mounted to a frame 242 can be spaced apart from one or more other tension knives 100 using spacer blocks 126 and 128. The tension knife 100 can have mounting points at opposite ends of the tension knife body such that when tension is applied to the knife, the spacer blocks 126 and 128 guide the knives within the frame 242 and ensure that tension is applied linearly with no rotation of the tension knife 100 or tension knife body. As shown in FIG. 12, finite element analysis (FEA) structural modeling demonstrates the effects of loading a tension knife 100 in tension. (For the illustrated analysis, deflection of the discrete elements has been exaggerated by twenty-five (25) times.) As seen in FIG. 12, a localized area at the leading edge 118 of the knife shows greater tension. This tension is created by the geometry of the leading edge 118 of the tension knife 100. The greater tension increases lateral stability of the tension knife 100 as the knife passes through a potato, which can reduce or minimize waviness of cuts that form, for example, French fries.

Figure 13:
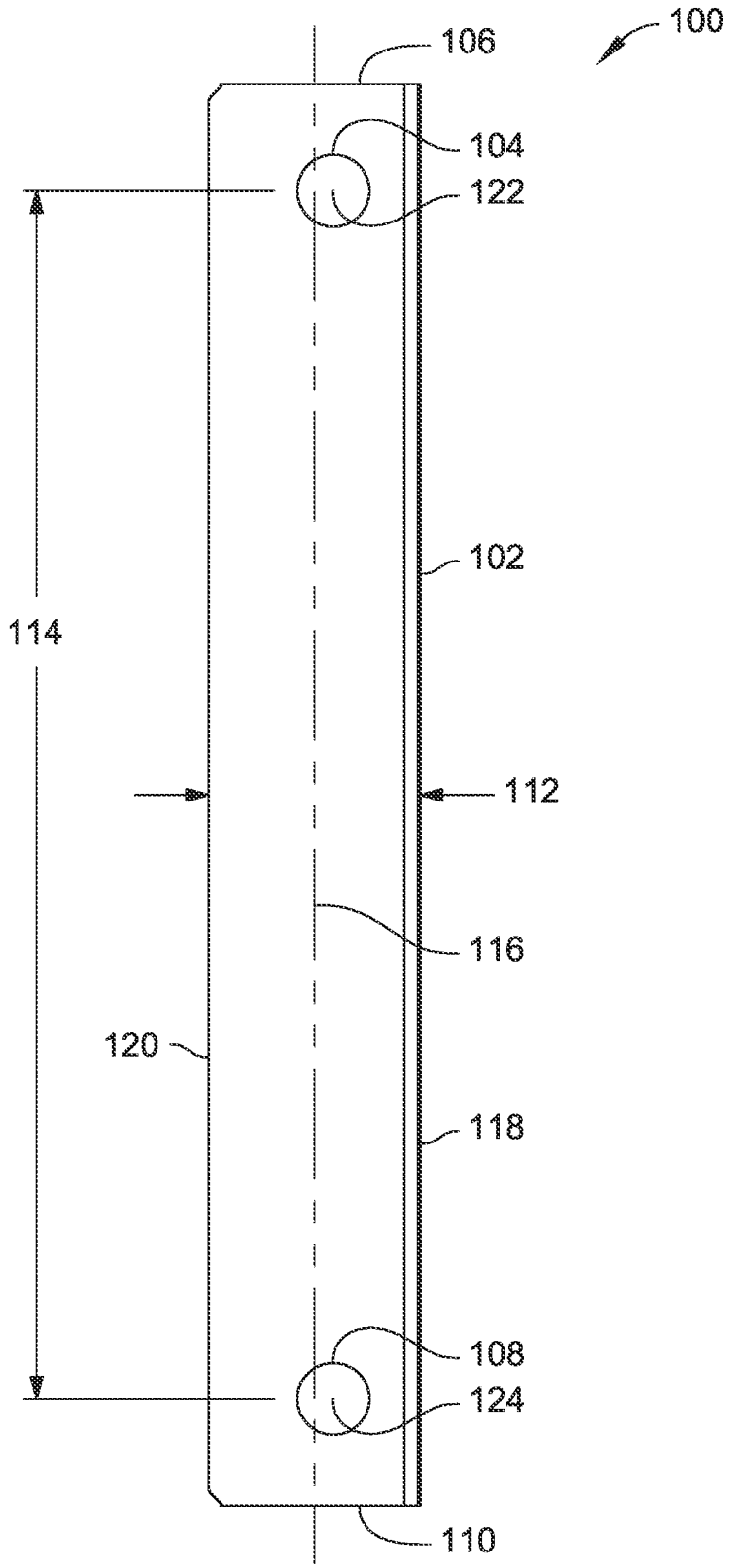
FIG. 13 is a top plan view illustrating a hybrid tension knife for a cutting unit, such as the cutting unit illustrated in FIG. 1, with mounting points biased toward a leading edge of the tension knife in accordance with example embodiments of the present disclosure.
Figure 14:
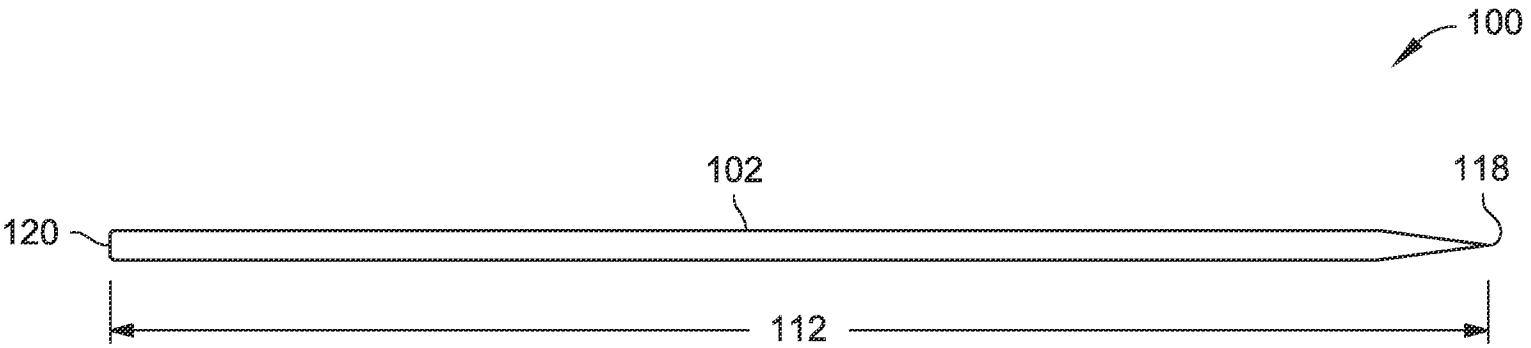
FIG. 14 is a side elevation view of the tension knife illustrated in FIG. 13.

Referring now to FIGS. 13 through 21, hybrid tension knives 100 are described in accordance with the present disclosure. As shown in FIGS. 13 and 14, a tension knife 100 includes an elongate knife body 102 having a thin, flat profile. In some embodiments, a tension knife 100 can be made from a metal material such as a hard stainless steel alloy material (e.g., grade 301 stainless steel, grade 302 stainless steel, and/or another alloy). The tension knife 100 defines a first mounting point 104 (e.g., a hole/aperture) at a first end 106 of the elongate knife body 102 and a second mounting point 108 (e.g., another hole/aperture) at a second end 110 of the elongate knife body 102 opposite the first end 106. The elongate knife body 102 has a characteristic width 112 across a length 114 of the elongate knife body 102 between the first mounting point 104 and the second mounting point 108. As described, the characteristic width 112 of the elongate knife body 102 defines a centerline 116 between a leading edge 118 of the elongate knife body 102 and a trailing edge 120 of the elongate knife body 102 opposite the leading edge 118. At least one of the first mounting point 104 or the second mounting point 108 has a focus 122 and/or a focus 124, respectively, between the centerline 116 and the leading edge 118 of the elongate knife body 102. The foci 122 and 124 can be the centers of knife holes and/or the centers of other shapes, such as square, rectangles, hexagons, and so forth. In this manner, the first mounting point 104 and the second mounting point 108 are biased toward the leading edge 118.

In some embodiments, the thickness of a tension knife 100 may be about sixteen one-thousandths of an inch (0.016"). This thickness may be about twice the thickness of a typical tension knife, which may have a thickness of about eight one-thousandths of an inch (0.008"). However, it should be noted that a sixteen one-thousandths of an inch (0.016") thickness is provided by way of example and is not meant to limit the present disclosure. In other embodiments, a tension knife 100 may have a thickness of less than sixteen one-thousandths of an inch (0.016") or more than sixteen one-thousandths of an inch (0.016"). For example, the thickness of a tension knife 100 can range from between about five one-thousandths of an inch (0.005") to about twenty-five one-thousandths of an inch (0.025"). For instance, the thickness of a tension knife 100 may range from about 0.12 mm, 0.13 mm, 0.14 mm, 0.15 mm, 0.16 mm, 0.17 mm, 0.18 mm, 0.19 mm, 0.20 mm, 0.21 mm, 0.22 mm, 0.23 mm, 0.24 mm, 0.25 mm, 0.26 mm, 0.27 mm, 0.28 mm, 0.29 mm, 0.30 mm, 0.31 mm, 0.32 mm, 0.33 mm, 0.34 mm, 0.35 mm, 0.36 mm, 0.37 mm, 0.38 mm, 0.39 mm, 0.40 mm, 0.41 mm, 0.42 mm, 0.43 mm, 0.44 mm, 0.45 mm, 0.46 mm, 0.47 mm, 0.48 mm, 0.49 mm, 0.50 mm, 0.51 mm, 0.52 mm, 0.53 mm, 0.54 mm, 0.55 mm, 0.56 mm, 0.57 mm, 0.58 mm, 0.59 mm, 0.60 mm, 0.61 mm, 0.62 mm, 0.63 mm, or 0.64 mm to about 0.12 mm, 0.13 mm, 0.14 mm, 0.15 mm, 0.16 mm, 0.17 mm, 0.18 mm, 0.19 mm, 0.20 mm, 0.21 mm, 0.22 mm, 0.23 mm, 0.24 mm, 0.25 mm, 0.26 mm, 0.27 mm, 0.28 mm, 0.29 mm, 0.30 mm, 0.31 mm, 0.32 mm, 0.33 mm, 0.34 mm, 0.35 mm, 0.36 mm, 0.37 mm, 0.38 mm, 0.39 mm, 0.40 mm, 0.41 mm, 0.42 mm, 0.43 mm, 0.44 mm, 0.45 mm, 0.46 mm, 0.47 mm, 0.48 mm, 0.49 mm, 0.50 mm, 0.51 mm, 0.52 mm, 0.53 mm, 0.54 mm, 0.55 mm, 0.56 mm, 0.57 mm, 0.58 mm, 0.59 mm, 0.60 mm, 0.61 mm, 0.62 mm, 0.63 mm, or 0.64 mm. In some embodiments, the leading edge 118 of a tension knife 100 may be sharpened (e.g., as shown in FIG. 14). However, in some embodiments, the leading edge 118 of a tension knife 100 may be a simple straight leading edge, which may be easily sharpened or may be unsharpened. In examples where the leading edge 118 of the tension knife 100 is sharpened, products cut with the tension knife 100 may have a better surface texture (e.g., a smoother texture with less product loss).

Figure 15:
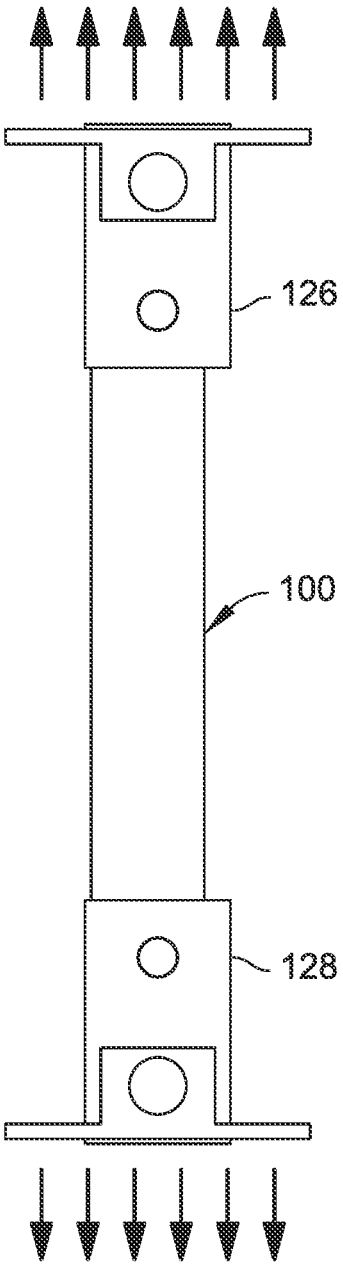
FIG. 15 is a top plan view illustrating an FEA structural model of an unloaded tension knife with mounting points biased toward a leading edge of the tension knife, such as the tension knife illustrated in FIG. 13.
Figure 16:
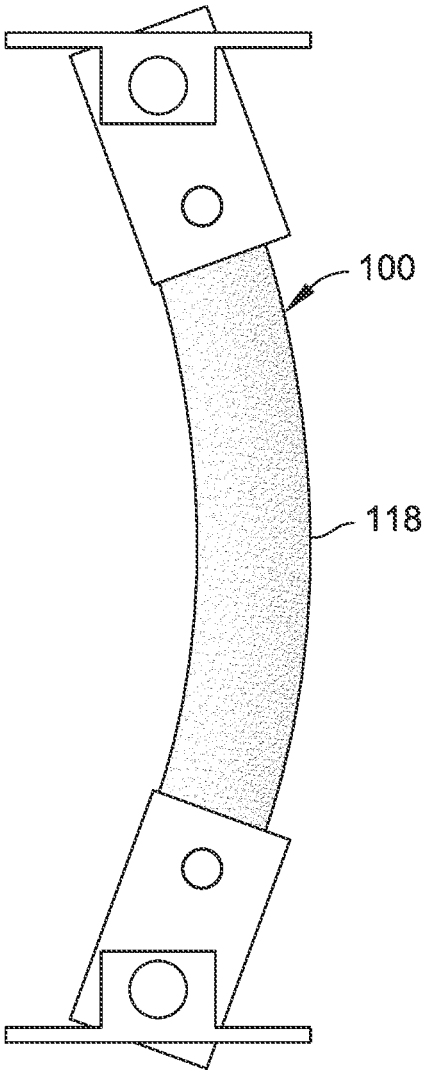
FIG. 16 is another top plan view of the FEA structural model illustrated in FIG. 15, where the tension knife is loaded in tension, and where deflection is exaggerated by twenty-five (25) times.

As shown in FIGS. 15 and 16, FEA structural modeling demonstrates biased tension force effects on a tension knife 100 loaded in tension when the first mounting point 104 and the second mounting point 108 of the knife are biased toward the leading edge 118. (For the illustrated analysis, bending rotation of the discrete elements has been exaggerated by twenty-five (25) times.) As seen in FIG. 16, the tension is spread across the leading edge 118 of the tension knife 100 rather than concentrated at a localized area at the leading edge of the knife (e.g., as previously described with reference to FIG. 12). It is noted that in order to produce a greater stress along the straight leading edge of the tension knife 100, e.g., when pulled by the offset or biased mounting points 104 and 108 or tension holes, clamp or spacer blocks 126 and 128 may be employed that allow the tension knife 100 to rotate within its frame (e.g., rotating about one or more of the mounting points 104 and/or 108). As described, the frame and spacer block arrangement may provide added clearance between the clamp or spacer blocks 126 and 128 and the frame to accomplish the rotation and thus tension the leading edge 118 to increase lateral stability and reduce or minimize waviness of cuts that form, for example, French fries. This arrangement contrasts with an arrangement where spacer blocks are constrained in a frame assembly and only allowed to translate and not rotate when tensioning a tension knife.

Figure 17:
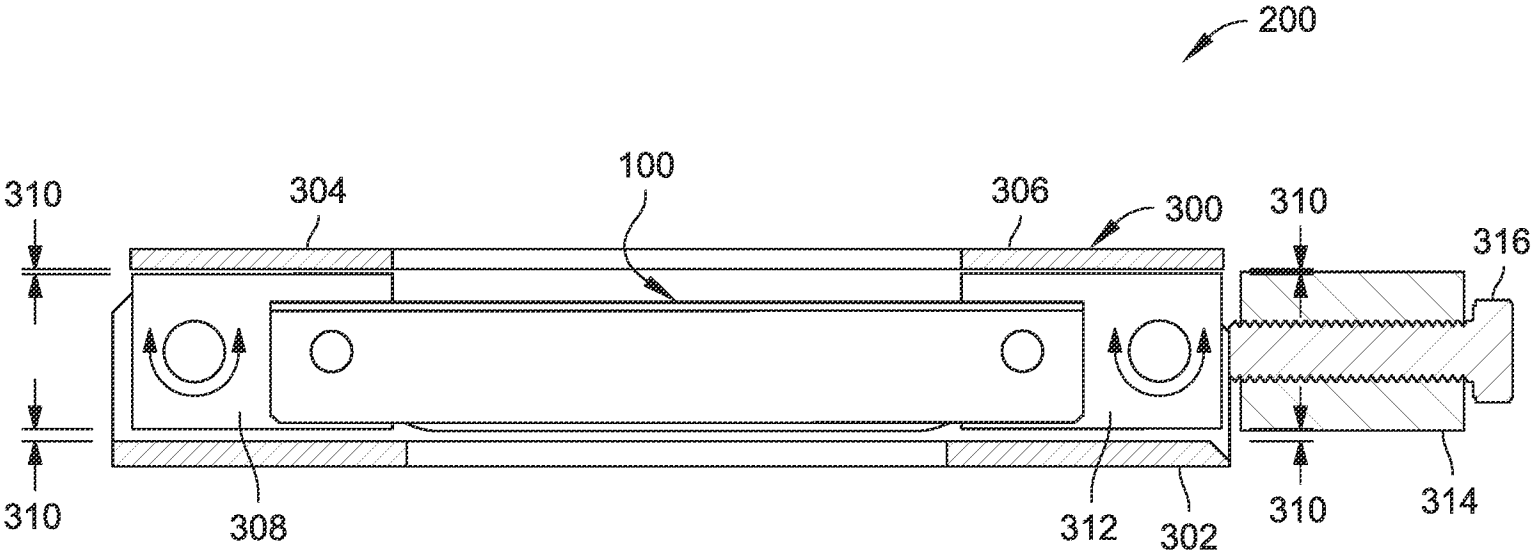
FIG. 17 is a partial cross-sectional side elevation view illustrating a tension fixture for a tension knife, such as the tension knife illustrated in FIG. 13, where the tension fixture can be mounted in a cutting unit, such as the cutting unit illustrated in FIG. 1, in accordance with example embodiments of the present disclosure.

Referring now to FIG. 17, a tension fixture 300 for a tension knife 100 is described. In embodiments of the disclosure, the tension fixture 300 allows the tension knife 100 to rotate with respect to, for example, the supporting structure of a cutting unit, such as the cutting unit described with reference to FIG. 1. As described, the tension knife 100 can be tensioned in a frame 302 that has a fixed pivot pin side 304 and a translating pivot pin side 306. The fixed pivot pin side 304 pins clamp blocks 308 to the frame 302 and allows them to rotate. In embodiments of the disclosure, there are one or more gaps 310 between the clamp blocks and the frame 302 that allow for rotation of the clamp blocks and the tension knife 100. One side of the frame 302 pins clamp blocks 312 to a translating tension block 314. The translating tension block 314 translates to one side (e.g., the right as shown in the accompanying figures) when one or more tension fasteners 316 (e.g., screws, bolts) are tightened. The tightening of the tension fasteners 316 applies tension to the tension knife 100 and, as the mounting points/holes and line of action of the force are off-center with respect to the tension knife 100, a tension plus bending stress is applied to the tension knife 100. The gaps 310 between the clamp blocks and the frame 302 allow for the resulting rotation that arises from the bending portion of the stress. One or more tension fixtures 300 can be configured to form, for instance, sets of blade assemblies and bases (e.g., as described with reference to FIGS. 7 and 8), and then assembled to form a cutting head for a cutting unit (e.g., as described with reference to FIG. 1).

Figure 18:
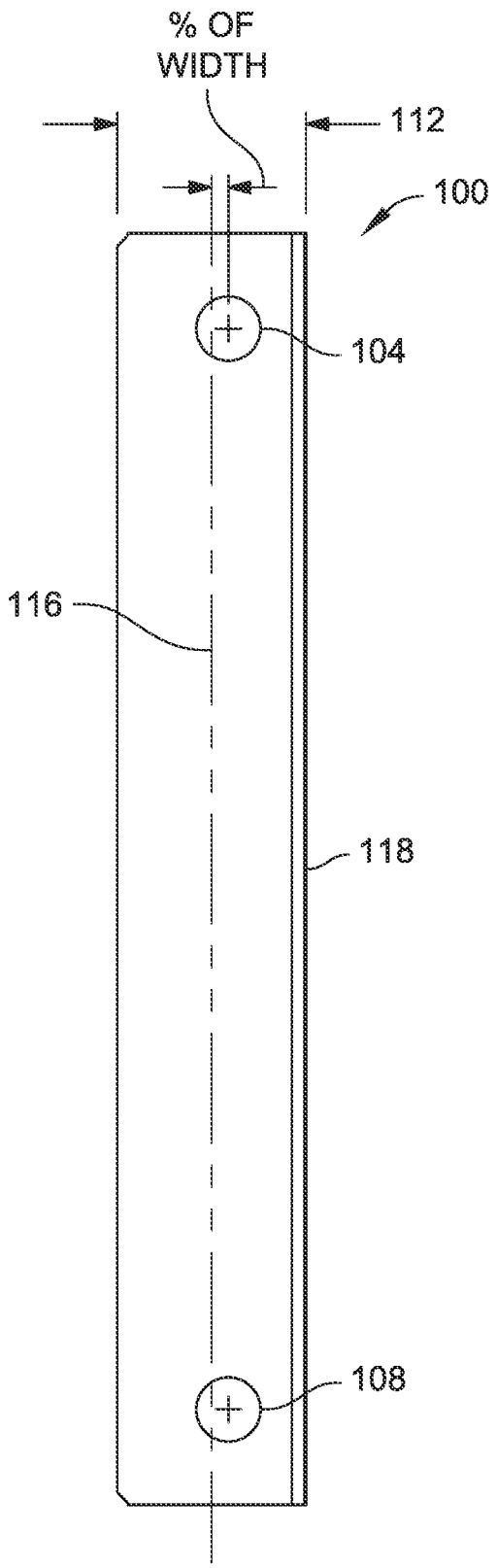
FIG. 18 is a top plan view illustrating a hybrid tension knife for a cutting unit, such as the cutting unit illustrated in FIG. 1, with mounting points biased toward a leading edge of the tension knife in accordance with example embodiments of the present disclosure.
Figure 19:
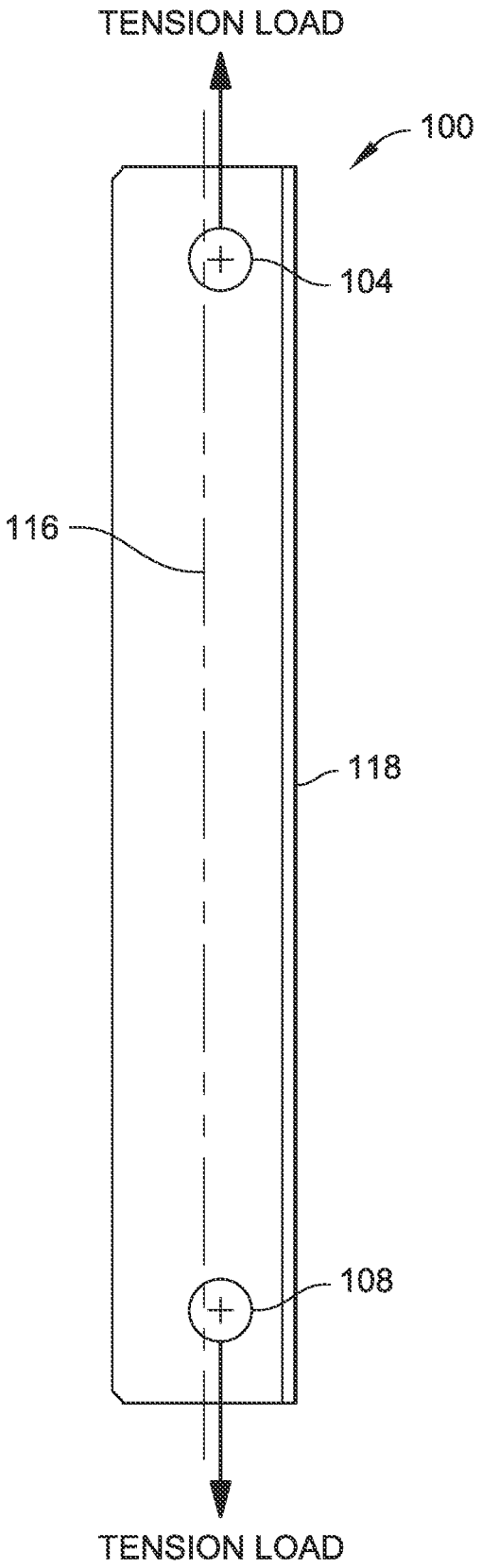
FIG. 19 is another top plan view of the tension knife illustrated in FIG. 18, where the tension knife is loaded in tension.
Figure 20:
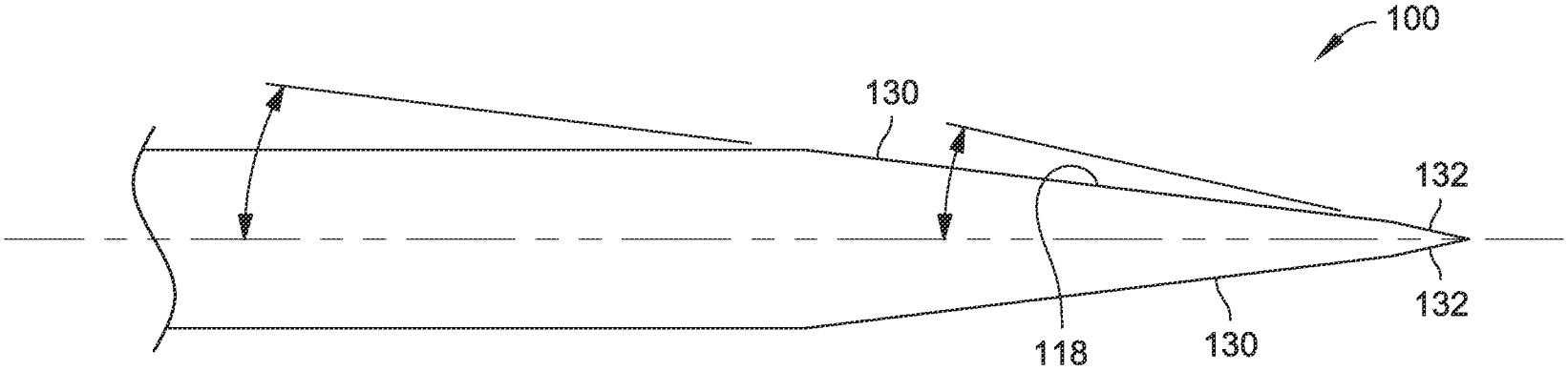
FIG. 20 is a partial cross-sectional side elevation view illustrating a leading edge of a tension knife for a cutting unit, such as the cutting unit illustrated in FIG. 1, where the leading edge has a double bevel in accordance with example embodiments of the present disclosure.

With reference to FIGS. 18 and 19, it is noted that the amount of offset of the mounting points 104 and 108 (e.g., knife holes) can control tension on the leading edge 118 of the tension knife 100. For example, although a mounting point or hole may not transfer all the load to the knife, it does represent the line of action of the loading applied to the knife. Clamp blocks/spacer blocks clamped tightly to the knife may spread the load over the entire area of contact between the spacers and the knife. It has been found that a leading-edge stress of between about one hundred and thirty percent and about one hundred and sixty percent (130%-160%) of the average stress in a knife can produce high quality French fries with minimal waviness. For the purposes of the present example, average stress is defined as the tension load divided by the cross-sectional area of the knife. In order to produce about a 130%-160% load condition on the leading edge, it has been found through structural analysis that, in some embodiments, the mounting points or holes may be offset towards the leading edge by between about eight percent and about ten percent (8%-10%) of the characteristic width 112 of the elongate knife body 102.

It should be noted that the leading-edge stress load condition and offset percentages described herein are provided by way of example and are not meant to limit the present disclosure. For example, the length and/or width of an elongate knife body 102 may vary based upon frame size. Thus, varying amounts of stress may be applied to the leading edge of a tension knife 100 using a different amount of offset from the centerline of the knife (e.g., less than about eight percent, such as about five percent (5%), more than about ten percent, such as about twenty-five percent (25%), and so forth). For example, the foci 122 and 124 of the first mounting point 104 and the second mounting point 108 may each be offset from the centerline 116 of the elongate knife body 102 by between about five percent (5%) of the characteristic width 112 of the elongate knife body 102 (e.g., in the case of a comparatively longer, narrower knife) and about twenty-five percent (25%) of the characteristic width 112 of the elongate knife body 102 (e.g., in the case of a comparatively shorter, wider knife). For instance, the offset towards the leading edge may range from about 5%, 6%, 7%, 8%, 9%, 10%, 11%, 12%, 13%, 14%, 15%, 16%, 17%, 18%, 19%, 20%, 21%, 22%, 23%, 24%, or 25% to about 5%, 6%, 7%, 8%, 9%, 10%, 11%, 12%, 13%, 14%, 15%, 16%, 17%, 18%, 19%, 20%, 21%, 22%, 23%, 24%, or 25%.

Figure 21:
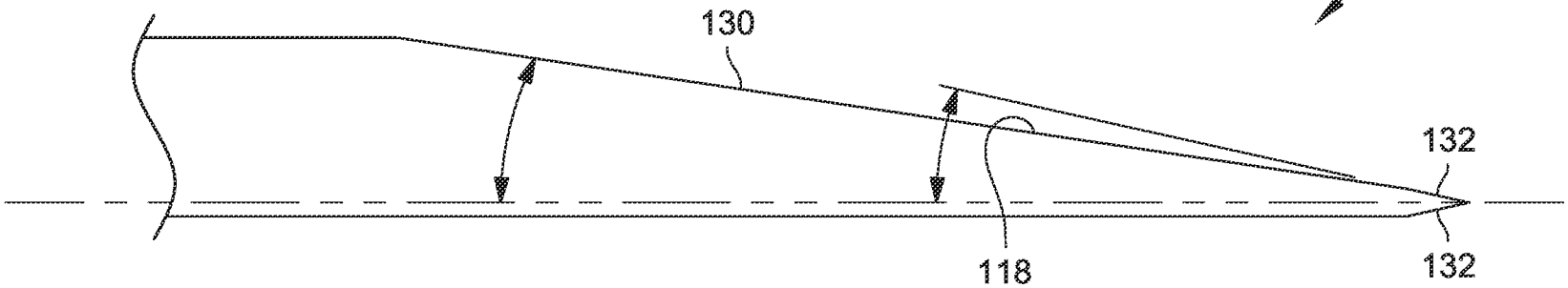
FIG. 21 is a partial cross-sectional side elevation view illustrating a leading edge of another tension knife for a cutting unit, such as the cutting unit illustrated in FIG. 1, where the leading edge has a single bevel on one side of the tension knife and a double bevel on another side of the tension knife in accordance with example embodiments of the present disclosure.

In some embodiments, the leading edge 118 of a tension knife 100 may have more than one bevel. For example, referring now to FIGS. 20 and 21, two or more bevels can be applied to one or both sides of a tension knife 100. In the example described with reference to FIG. 20, a double bevel leading edge can have primary and secondary bevels on both sides of the knife, e.g., primary bevels 130 and secondary bevels 132 on both sides. In some embodiments, the primary bevel 130 can range from about six and one-half degrees to about seven and one-half degrees (6.5°-7.5°) from a centerline of the knife as shown, and the secondary bevel 132 can range from about twelve degrees to about thirteen degrees (12°-13°) from the centerline. This arrangement can provide equal lateral force to the potato as it is cut. With reference to FIG. 21, a single bevel leading edge can have a primary bevel on only one side of the knife, e.g., primary bevel 130 and secondary bevel 132 on one side and secondary bevel 132 on an opposing side. In some embodiments, the primary bevel 130 can be about eight and one-half degrees (8.5°) from a centerline of the knife as shown, and the secondary bevel 132 can range from about twelve degrees to about thirteen degrees (12°-13°) from the centerline. Although this design can produce unequal lateral forces on a vegetable such as a potato when cut, it can also allow for a smaller primary bevel angle, which may provide a cleaner or more precise cut for delicate products. It should be noted that these bevel angles are provided by way of example and are not meant to limit the present disclosure. Thus, a tension knife 100 may have different primary, secondary, and/or other angles.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tension knife comprising:

an elongate knife body having a thin, flat profile and defining a first mounting point at a first end of the elongate knife body and a second mounting point at a second end of the elongate knife body opposite the first end;

the elongate knife body having a characteristic width across a length of the elongate knife body between the first mounting point and the second mounting point;

the characteristic width of the elongate knife body defining a centerline between a leading edge of the elongate knife body and a trailing edge of the elongate knife body opposite the leading edge; and at least one of the first mounting point or the second mounting point having a focus between the centerline of the elongate knife body and the leading edge, the foci of the first mounting point and the second mounting point each offset from the centerline of the elongate knife body by between about five percent (5%) and about twenty-five percent (25%) of the characteristic width of the elongate knife body.

2. The tension knife as recited in claim 1, wherein at least one of the first mounting point or the second mounting point comprises an aperture.

3. The tension knife as recited in claim 1, wherein the leading edge of the tension knife is sharpened.

4. The tension knife as recited in claim 1, wherein the leading edge of the tension knife has a first side and an opposing second side, and at least one of the first side or the second side has at least two bevels.

5. The tension knife as recited in claim 1, wherein the leading edge of the tension knife is angled.

6. The tension knife as recited in claim 1, wherein the leading edge of the tension knife is recessed.

7. A tension knife assembly comprising:

a tension knife including:

an elongate knife body having a thin, flat profile and defining a first mounting point at a first end of the elongate knife body and a second mounting point at a second end of the elongate knife body opposite the first end, the elongate knife body having a characteristic width across a length of the elongate knife body between the first mounting point and the second mounting point, the characteristic width of the elongate knife body defining a centerline between a leading edge of the elongate knife body and a trailing edge of the elongate knife body opposite the leading edge, and at least one of the first mounting point or the second mounting point having a focus between the centerline of the elongate knife body and the leading edge, the foci of the first mounting point and the second mounting point each offset from the centerline of the elongate knife body by between about five percent (5%) and about twenty-five percent (25%) of the characteristic width of the elongate knife body;

a frame for supporting and tensioning the tension knife; and a plurality of clamp blocks for mounting the tension knife to the frame at the first mounting point and the second mounting point, at least one of the clamp blocks configured to rotate with respect to the frame to tension the leading edge of the tension knife.

8. The tension knife assembly as recited in claim 7, wherein at least one of the first mounting point or the second mounting point comprises an aperture.

9. The tension knife assembly as recited in claim 7, wherein the leading edge of the tension knife is sharpened.

10. The tension knife assembly as recited in claim 7, wherein the leading edge of the tension knife has a first side and an opposing second side, and at least one of the first side or the second side has at least two bevels.

11. The tension knife assembly as recited in claim 7, wherein the leading edge of the tension knife is angled.

12. The tension knife assembly as recited in claim 7, wherein the leading edge of the tension knife is recessed.

13. The tension knife assembly as recited in claim 7, wherein the frame is configured to allow one of the first end or the second end of the elongate knife body to rotate and the other of the first end or the second end of the elongate knife body to rotate and translate with respect to the frame.

14. A tension knife comprising:

an elongate knife body having a thin, flat profile and defining a first mounting point at a first end of the elongate knife body and a second mounting point at a second end of the elongate knife body opposite the first end;

the elongate knife body having a characteristic width across a length of the elongate knife body between the first mounting point and the second mounting point;

the characteristic width of the elongate knife body defining a centerline between a recessed leading edge of the elongate knife body and a trailing edge of the elongate knife body opposite the leading edge; and the first mounting point and the second mounting point each having a focus between the centerline of the elongate knife body and the leading edge, the foci of the first mounting point and the second mounting point each offset from the centerline of the elongate knife body by between about five percent (5%) and about twenty-five percent (25%) of the characteristic width of the elongate knife body.

15. The tension knife as recited in claim 14, wherein at least one of the first mounting point or the second mounting point comprises an aperture.

16. The tension knife as recited in claim 14, wherein the leading edge of the tension knife is sharpened.

17. The tension knife as recited in claim 14, wherein the leading edge of the tension knife has a first side and an opposing second side, and at least one of the first side or the second side has at least two bevels.

18. A tension knife assembly comprising:

a tension knife including:

an elongate knife body having a thin, flat profile and defining a first mounting point at a first end of the elongate knife body and a second mounting point at a second end of the elongate knife body opposite the first end, the elongate knife body having a characteristic width across a length of the elongate knife body between the first mounting point and the second mounting point, the characteristic width of the elongate knife body defining a centerline between a leading edge of the elongate knife body and a trailing edge of the elongate knife body opposite the leading edge, and at least one of the first mounting point or the second mounting point having a focus between the centerline of the elongate knife body and the leading edge;

a frame for supporting and tensioning the tension knife, the frame configured to allow one of the first end or the second end of the elongate knife body to rotate and the other of the first end or the second end of the elongate knife body to rotate and translate with respect to the frame; and a plurality of clamp blocks for mounting the tension knife to the frame at the first mounting point and the second mounting point, at least one of the clamp blocks configured to rotate with respect to the frame to tension the leading edge of the tension knife.

* * * * *